US010322845B2

(12) United States Patent
Boersma et al.

(10) Patent No.: US 10,322,845 B2
(45) Date of Patent: Jun. 18, 2019

(54) CARTON WITH INSERT

(71) Applicant: Graphic Packaging International, Inc., Atlanta, GA (US)

(72) Inventors: Harmen Boersma, Heerenveen (NL); Rene Knijpstra, Rottum (NL); Jouke Hilarides, Oosthem (NL); Robert Ackroyd, Leeds (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/349,135

(22) Filed: Nov. 11, 2016

(65) Prior Publication Data

US 2017/0057690 A1 Mar. 2, 2017

Related U.S. Application Data

(63) Continuation-in-part of application No. 14/644,450, filed on Mar. 11, 2015.
(Continued)

(51) Int. Cl.
*B65D 5/50* (2006.01)
*B65D 85/30* (2006.01)
(Continued)

(52) U.S. Cl.
CPC ..... *B65D 5/5076* (2013.01); *B65D 5/445* (2013.01); *B65D 5/5014* (2013.01);
(Continued)

(58) Field of Classification Search
CPC ..... B65D 5/50; B65D 5/44; B65D 5/5028; B65D 5/445; B65D 85/30; B65D 81/113;
(Continued)

(56) References Cited

U.S. PATENT DOCUMENTS 217,559 A 7/1879 Swope
975,121 A 11/1910 Carter
(Continued)

FOREIGN PATENT DOCUMENTS

CA 873185 6/1971
DE 80 22 379.6 10/1981
(Continued)

OTHER PUBLICATIONS

Response to Restriction Requirement for U.S. Appl. No. 14/644,450 dated Jun. 14, 2016.
(Continued)

*Primary Examiner* — Andrew D Perreault
(74) *Attorney, Agent, or Firm* — Womble Bond Dickinson (US) LLP

(57) ABSTRACT

A carton for holding an article. The carton can comprise a plurality of panels that extends at least partially around an interior of the carton. The plurality of panels can comprise a first panel and a second panel. An insert can comprise a central panel, an inner end panel disposed generally opposite to the central panel, an inner side panel foldably connected to the central panel, and an inner flap foldably connected to the inner side panel. The central panel can extend generally parallel to the first panel, the inner side panel can extend generally parallel to the second panel, and the inner end panel can at least partially overlap the inner flap.

27 Claims, 15 Drawing Sheets

Related U.S. Application Data

(60) Provisional application No. 61/967,133, filed on Mar. 11, 2014.

(51) Int. Cl.
*B65D 5/44* (2006.01)
*B65D 5/10* (2006.01)
*B65D 5/40* (2006.01)
*B65D 5/02* (2006.01)

(52) U.S. Cl.
CPC ..... *B65D 5/5016* (2013.01); *B65D 5/0281* (2013.01); *B65D 5/103* (2013.01)

(58) Field of Classification Search
CPC .... B65D 81/05; B65D 85/305; B65D 5/5021; B65D 5/5023; B65D 5/503; B65D 5/5076; B65D 5/5014; B65D 5/5016; B65D 5/0281; B65D 5/103
USPC ..... 206/592, 591, 594, 512
See application file for complete search history.

(56) References Cited

U.S. PATENT DOCUMENTS 1,039,026 A 9/1912 Carter
1,481,333 A 1/1924 Agar
1,925,102 A 9/1933 Levkoff
1,983,418 A 12/1934 Thurmer
2,005,924 A 6/1935 Wilson
2,067,749 A 1/1937 Zimmerman et al.
2,115,673 A 4/1938 Stompe
2,196,502 A 4/1940 Kells
2,299,027 A 10/1942 Novak
2,300,473 A 11/1942 Van Winkle
2,353,376 A 7/1944 Vatter
2,367,345 A 1/1945 Fischer
2,386,905 A 10/1945 Meitzen
2,421,748 A 6/1947 Fink
2,422,152 A 6/1947 Vatter
2,469,497 A 5/1949 Conway
2,513,902 A * 7/1950 Tyrseck ..... B65D 5/58 206/521
2,514,651 A 7/1950 Kornfield et al.
2,537,151 A 1/1951 Mires
2,620,116 A 12/1952 McDonough
2,648,484 A 8/1953 Belsinger
2,669,351 A 2/1954 Carson et al.
2,754,047 A 7/1956 Schmidt et al.
2,840,293 A 6/1958 Paige
2,856,067 A 10/1958 Sparks
2,979,248 A 4/1961 Washington
3,078,032 A 2/1963 Robinson et al.
3,128,010 A 4/1964 Forrer
3,133,634 A 5/1964 Bozdar
3,173,596 A 3/1965 Aust et al.
3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,307,768 A 3/1967 Growney
3,332,594 A 7/1967 De Capua
3,346,167 A 10/1967 Schmidt
3,356,279 A 12/1967 Root
3,517,858 A 6/1970 Farquhar
3,533,549 A 10/1970 Gilchrist
3,540,581 A 11/1970 Koolnis
3,616,897 A 11/1971 Vrana
3,640,448 A 2/1972 Wood
3,825,170 A 7/1974 Aust et al.
3,904,036 A 9/1975 Forrer
3,963,121 A 6/1976 Kipp
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A 5/1986 Holley, Jr.
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,836,375 A 6/1989 Schuster
4,869,599 A 9/1989 Allen
4,890,440 A 1/1990 Romagnoli
4,949,845 A 8/1990 Dixon
4,967,901 A 11/1990 Wood
4,974,771 A 12/1990 Lavery
5,000,313 A 3/1991 Oliff
5,040,696 A 8/1991 Liebel
5,072,876 A 12/1991 Wilson
5,101,642 A 4/1992 Alexandrov
5,119,985 A 6/1992 Dawson et al.
5,137,211 A 8/1992 Summer et al.
5,180,054 A 1/1993 Bakx
5,219,229 A 6/1993 Sengewald
5,246,112 A 9/1993 Stout et al.
5,249,681 A 10/1993 Miller
5,297,725 A 3/1994 Sutherland
5,320,277 A 6/1994 Stout et al.
5,333,734 A 8/1994 Stout et al.
5,335,846 A 8/1994 Smith
5,350,109 A 9/1994 Brown et al.
5,351,878 A 10/1994 Cooper
5,425,474 A 6/1995 Dalea et al.
5,427,241 A 6/1995 Sutherland
5,462,171 A 10/1995 Moog et al.
5,482,185 A 1/1996 McNaughton
5,482,203 A 1/1996 Stout
5,505,372 A 4/1996 Edson et al.
5,549,197 A 8/1996 Sutherland
5,577,612 A 11/1996 Chesson et al.
5,588,585 A 12/1996 McClure
5,597,114 A 1/1997 Kramedjian et al.
5,622,309 A 4/1997 Matsuda et al.
5,639,017 A 6/1997 Fogle
5,664,683 A 9/1997 Brody
5,690,213 A 11/1997 Matsumura
5,690,230 A 11/1997 Griffith
5,704,470 A 1/1998 Sutherland
5,788,077 A 8/1998 Sisk
5,794,778 A 8/1998 Harris
5,806,981 A 9/1998 Schisler
5,826,783 A 10/1998 Stout
5,873,516 A 2/1999 Boggs
5,875,961 A 3/1999 Stone et al.
5,881,884 A 3/1999 Podosek
5,899,377 A 5/1999 Speese et al.
5,921,398 A 7/1999 Carroll
5,924,559 A 7/1999 Carrel et al.
5,927,498 A 7/1999 Saam
5,975,300 A 11/1999 Gale
6,029,886 A 2/2000 Sheffer
6,050,402 A 4/2000 Walter
6,170,741 B1 1/2001 Skolik et al.
6,176,419 B1 1/2001 Holley, Jr.
6,250,542 B1 6/2001 Negelen
6,283,293 B1 9/2001 Lingamfelter
6,302,320 B1 10/2001 Stout
6,341,689 B1 1/2002 Jones
6,409,077 B1 6/2002 Telesca et al.
D459,927 S 7/2002 Flowers et al.

(56) References Cited

U.S. PATENT DOCUMENTS

| | | | |
|---|---|---|---|
| 6,422,454 | B1 | 7/2002 | Barr et al. |
| 6,471,120 | B1 | 10/2002 | Vogel |
| 6,478,219 | B1 | 11/2002 | Holley, Jr. |
| 6,484,903 | B2 | 11/2002 | Spivey et al. |
| 6,536,654 | B2 | 3/2003 | Reynolds et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |
| 6,631,803 | B2 | 10/2003 | Rhodes et al. |
| 6,669,083 | B2 | 12/2003 | Bates |
| 6,685,025 | B1 | 2/2004 | Kari |
| 6,715,639 | B2 | 4/2004 | Spivey |
| 6,752,262 | B1 | 6/2004 | Boriani et al. |
| 6,789,673 | B2 | 9/2004 | Lingamfelter |
| 6,848,573 | B2 | 2/2005 | Gould et al. |
| 6,866,186 | B2 | 3/2005 | Fogle et al. |
| 6,902,104 | B2 | 6/2005 | Holley, Jr. et al. |
| 6,918,487 | B2 | 7/2005 | Harrelson |
| 6,926,193 | B2 | 8/2005 | Smalley |
| 6,929,172 | B2 | 8/2005 | Bates et al. |
| 6,932,265 | B2 | 8/2005 | Sax et al. |
| 6,968,992 | B2 | 11/2005 | Schuster |
| 6,969,172 | B2 | 11/2005 | Actis-Datta |
| 6,974,072 | B2 | 12/2005 | Harrelson |
| 6,990,786 | B2 | 1/2006 | Kilmartin |
| 6,991,107 | B2 | 1/2006 | Harrelson |
| 6,997,316 | B2 | 2/2006 | Sutherland |
| 7,000,803 | B2 | 2/2006 | Miller |
| 7,021,024 | B2 | 4/2006 | Kari |
| 7,073,665 | B2 | 7/2006 | Auclair et al. |
| 7,097,034 | B2 | 8/2006 | Woog |
| 7,104,435 | B2 | 9/2006 | Holley, Jr. |
| 7,134,593 | B2 | 11/2006 | Harrelson |
| 7,159,759 | B2 | 1/2007 | Sutherland et al. |
| 7,225,930 | B2 | 6/2007 | Ford et al. |
| 7,258,235 | B2 | 8/2007 | Liu et al. |
| 7,320,406 | B2 | 1/2008 | Auclair |
| 7,422,104 | B2 | 9/2008 | Perkinson |
| 7,478,743 | B2 | 1/2009 | Holley, Jr. |
| 7,604,157 | B2 | 10/2009 | Zammit et al. |
| 7,644,858 | B2 | 1/2010 | Glaser et al. |
| 7,648,031 | B2 | 1/2010 | Kari |
| 7,699,163 | B2 | 4/2010 | Gomes et al. |
| 7,699,215 | B2 | 4/2010 | Spivey, Sr. |
| 8,439,194 | B2 | 5/2013 | Spivey |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2003/0006158 | A1 | 1/2003 | Skolik et al. |
| 2003/0034273 | A1 | 2/2003 | Auclair |
| 2003/0136820 | A1 | 7/2003 | Negelen |
| 2003/0141313 | A1 | 7/2003 | Bates |
| 2003/0150759 | A1 | 8/2003 | White, Jr. |
| 2003/0192907 | A1 | 10/2003 | Bates |
| 2004/0040334 | A1 | 3/2004 | Rusnock |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0188508 | A1 | 9/2004 | Holley, Jr. et al. |
| 2005/0023170 | A1 | 2/2005 | Lingamfelter |
| 2005/0092820 | A1 | 5/2005 | Chekroune |
| 2005/0115843 | A1 | 6/2005 | Harrelson |
| 2005/0126947 | A1 | 6/2005 | Holley et al. |
| 2005/0167291 | A1 | 8/2005 | Sutherland |
| 2005/0167478 | A1 | 8/2005 | Holley, Jr. |
| 2005/0189405 | A1 | 9/2005 | Gomes et al. |
| 2005/0263574 | A1 | 12/2005 | Schuster |
| 2006/0042983 | A1 | 3/2006 | Liu et al. |
| 2006/0054522 | A1 | 3/2006 | Kline et al. |
| 2006/0081691 | A1 | 4/2006 | Smalley |
| 2006/0091193 | A1 | 5/2006 | DeBusk et al. |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2006/0231441 | A1 | 10/2006 | Gomes et al. |
| 2006/0231600 | A1 | 10/2006 | Holley |
| 2006/0249413 | A1 | 11/2006 | Auclair et al. |
| 2006/0278689 | A1 | 12/2006 | Boshinski et al. |
| 2007/0007325 | A1 | 1/2007 | Suzuki et al. |
| 2007/0029371 | A1 | 2/2007 | Theelen |
| 2007/0108261 | A1 | 5/2007 | Schuster |
| 2007/0131748 | A1 | 6/2007 | Brand |
| 2007/0164093 | A1 | 7/2007 | Spivey et al. |
| 2007/0181658 | A1 | 8/2007 | Sutherland |
| 2007/0205255 | A1 | 9/2007 | Dunn |
| 2007/0210144 | A1 | 9/2007 | Brand |
| 2007/0251982 | A1 | 11/2007 | Brand |
| 2007/0295790 | A1 | 12/2007 | Zammit et al. |
| 2008/0023535 | A1 | 1/2008 | Holley, Jr. |
| 2008/0048014 | A1 | 2/2008 | Bates |
| 2008/0128479 | A1 | 6/2008 | Bates et al. |
| 2008/0302691 | A1 | 12/2008 | Olson et al. |
| 2009/0282843 | A1 | 11/2009 | Brand |
| 2010/0044420 | A1 | 2/2010 | Brand |
| 2010/0122999 | A1 | 5/2010 | Brand |
| 2010/0237138 | A1 | 9/2010 | Bradford |
| 2011/0011924 | A1 | 1/2011 | Spivey et al. |
| 2011/0024318 | A1 | 2/2011 | Gilfert |
| 2011/0049228 | A1 | 3/2011 | Brand |
| 2011/0290692 | A1 | 12/2011 | Spivey, Sr. |

FOREIGN PATENT DOCUMENTS

| | | | |
|---|---|---|---|
| DE | 90 13 924.0 | U1 | 1/1991 |
| DE | 41 30 883 | A1 | 4/1992 |
| EP | 0 066 029 | | 12/1982 |
| EP | 1 433 714 | | 6/2004 |
| EP | 1 698 565 | | 9/2006 |
| FR | 1 324 316 | | 4/1963 |
| FR | 1 402 998 | A | 6/1965 |
| FR | 2 549 010 | | 1/1985 |
| FR | 2 841 216 | | 12/2003 |
| FR | 2 854 141 | A1 | 10/2004 |
| FR | 2 915 181 | A1 | 10/2008 |
| GB | 1 242 723 | | 8/1971 |
| GB | 1 395 644 | | 5/1975 |
| GB | 2 115 383 | | 9/1983 |
| GB | 2 264 101 | | 8/1993 |
| JP | 56-34759 | | 4/1981 |
| JP | 63-202621 | | 12/1988 |
| JP | 6-183461 | | 7/1994 |
| JP | 3053681 | | 11/1998 |
| JP | 2002-128064 | | 5/2002 |
| JP | 2004-142775 | A | 5/2004 |
| JP | 2006-111342 | | 4/2006 |
| JP | 2006-240683 | A | 9/2006 |
| JP | 2007-055630 | | 3/2007 |
| JP | 2007-532421 | | 11/2007 |
| JP | 2010-149927 | | 7/2010 |
| KR | 10-0154124 | | 2/1999 |
| KR | 10-0371048 | | 8/2003 |
| KR | 10-1039192 | B1 | 6/2011 |
| KR | 10-2011-0096657 | A | 8/2011 |
| NZ | 509745 | | 8/2003 |
| WO | WO 96/21603 | | 7/1996 |
| WO | WO 96/29260 | | 9/1996 |
| WO | WO 99/28198 | | 6/1999 |
| WO | WO 99/64301 | | 12/1999 |
| WO | WO 00/03937 | | 1/2000 |
| WO | WO 00/76863 | | 12/2000 |
| WO | WO 02/47990 | | 6/2002 |
| WO | WO 2004/043790 | | 5/2004 |
| WO | WO 2005/051781 | | 6/2005 |
| WO | WO 2005/100175 | | 10/2005 |
| WO | WO 2006/050210 | | 5/2006 |

(56) References Cited

FOREIGN PATENT DOCUMENTS

| | | |
|---|---|---|
| WO | WO 2006/050316 | 5/2006 |
| WO | WO 2007/076544 | 7/2007 |

OTHER PUBLICATIONS

Office Action for U.S. Appl. No. 14/644,450 dated Sep. 2, 2016.
Amendment A and Response to Office Action for U.S. Appl. No. 14/644,450 dated Dec. 2, 2016.
Office Action for CN 201580012088.1 dated Jul. 27, 2017.
Office Action for U.S. Appl. No. 14/644,450 dated Mar. 14, 2017.
Request for Continued Examination (RCE) Transmittal for U.S. Appl. No. 14/644,450 dated May 15, 2017.
Amendment B and Response to Final Office Action for U.S. Appl. No. 14/644,450 dated May 15, 2017.
Office Action for U.S. Appl. No. 14/644,450 dated Aug. 18, 2017.
International Search Report and Written Opinion for PCT/US2015/019838 dated Jun. 25, 2015.
Office Action for U.S. Appl. No. 14/644,450 dated Apr. 15, 2016.
Supplementary European Search Report for EP 15 76 0677 dated Oct. 27, 2017.
Notification of Reasons for Refusal for Japanese Application No. 2016-555811 dated Jun. 25, 2018, and English translation.

* cited by examiner

CARTON WITH INSERT

CROSS REFERENCE TO RELATED APPLICATIONS

This application is a continuation-in-part of U.S. patent application Ser. No. 14/644,450, filed Mar. 11, 2015, which claims the benefit of U.S. Provisional Patent Application No. 61/967,133, filed Mar. 11, 2014.

INCORPORATION BY REFERENCE

The disclosures of U.S. patent application Ser. No. 14/644,450, which was filed Mar. 11, 2015, and U.S. Provisional Patent Application No. 61/967,133, which was filed on Mar. 11, 2014, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having an insert.

SUMMARY OF THE DISCLOSURE

In general, one aspect of the disclosure is directed to a carton for holding an article. The carton can comprise a plurality of panels that extends at least partially around an interior of the carton. The plurality of panels can comprise a first panel and a second panel. An insert can comprise a central panel, an inner side panel foldably connected to the central panel, and an inner flap foldably connected to the inner side panel. The first panel can at least partially overlap the central panel, the inner side panel can be spaced apart from the second panel, and at least a portion of the inner flap can extend from the inner side panel to the second panel.

In another aspect, the disclosure is generally directed to, in combination, a carton blank and an insert blank for forming a carton and an insert at least partially disposed in the carton for holding an article. The carton blank can comprise a plurality of panels comprising a first panel and a second panel. The insert blank can comprise a central panel, an inner side panel foldably connected to the central panel, and an inner flap foldably connected to the inner side panel. The first panel can be for at least partially overlapping the central panel when the carton is formed from the carton blank and the insert blank. The inner side panel can be for being spaced apart from the second panel and at least a portion of the inner flap can be for extending from the inner side panel to the second panel when the carton and the insert are formed from the carton blank and the insert blank.

In another aspect, the disclosure is generally directed to a blank for forming a carton for holding an article. The blank can comprise a first portion comprising a plurality of panels comprising a first panel and a second panel. The blank further can comprise a second portion for forming an inner spacer feature in the carton formed from the blank. The second portion can comprise a central panel, an inner side panel foldably connected to the central panel, and an inner flap foldably connected to the inner side panel. The first panel can be for at least partially overlapping the central panel when the carton is formed from the blank. The inner side panel can be for being spaced apart from the second panel and at least a portion of the inner flap can be for extending from the inner side panel to the second panel when the carton is formed from the blank.

In another aspect, the disclosure is generally directed to a method of forming a carton for holding an article. The method can comprise obtaining a carton blank and an insert blank. The carton blank can comprise a plurality of panels comprising a first panel and a second panel, and the insert blank can comprise a central panel, an inner side panel foldably connected to the central panel, and an inner flap foldably connected to the inner side panel. The method further can comprise forming an interior of the carton at least partially defined by the plurality of panels of the carton blank. The forming the interior of the carton can comprise forming an open-ended sleeve. The method also can comprise forming an insert from the insert blank. The first panel can at least partially overlap the central panel, the inner side panel can be spaced apart from the outer side panel, and at least a portion of the inner flap can extend from the inner side panel to the outer side panel.

In another aspect, the disclosure is generally directed to a carton for holding an article. The carton can comprise a plurality of panels that extends at least partially around an interior of the carton, the plurality of panels comprising a first panel, a second panel, and a third panel. An insert can comprise a central panel, an inner side panel foldably connected to the central panel, and an inner flap foldably connected to the inner side panel. The central panel can be at least partially secured to the first panel, the inner side panel can be spaced apart from the second panel, and the inner flap can be at least partially secured to the third panel.

In another aspect, the disclosure is generally directed to a carton for holding an article. The carton can comprise a plurality of panels that extends at least partially around an interior of the carton. The plurality of panels can comprise a first panel and a second panel. An insert can comprise a central panel, an inner end panel disposed generally opposite to the central panel, an inner side panel foldably connected to the central panel, and an inner flap foldably connected to the inner side panel. The central panel can extend generally parallel to the first panel, the inner side panel can extend generally parallel to the second panel, and the inner end panel can at least partially overlap the inner flap.

In another aspect, the disclosure is generally directed to, in combination, a carton blank and an insert blank for forming a carton for holding an article. The carton blank can comprise a plurality of panels comprising a first panel and a second panel. The insert blank can comprise a central panel, an inner end panel for being disposed generally opposite to the central panel when the carton is formed from the carton blank and the insert blank, an inner side panel foldably connected to the central panel, and an inner flap foldably connected to the inner side panel. The central panel can be for extending generally parallel to the first panel when the carton is formed from the carton blank and the insert blank, the inner side panel can be for extending generally parallel to the second panel when the carton is formed from the carton blank and the insert blank, and the inner end panel can be for at least partially overlapping the inner flap when the carton is formed from the carton blank and the insert blank.

In another aspect, the disclosure is generally directed to a method of forming a carton for holding an article. The method can comprise obtaining a carton blank and an insert blank. The carton blank can comprise a plurality of panels comprising a first panel and a second panel. The insert blank can comprise a central panel, an inner end panel, an inner side panel foldably connected to the central panel, and an inner flap foldably connected to the inner side panel. The method further can comprise forming an interior of the carton at least partially defined by the plurality of panels of the carton blank. The forming the interior of the carton can comprise forming an open-ended sleeve. The method also can comprise forming an insert from the insert blank. The forming the insert can comprise disposing the inner end panel generally opposite to the central panel, positioning the central panel to be generally parallel to the first panel, positioning the inner side panel to extend generally parallel to the second panel, and positioning the inner flap so that the inner end flap at least partially overlaps the inner flap.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain an article or articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; aseptic bricks; paperboard; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes a beverage container (e.g., a glass bottle) as disposed within the carton embodiments. In this specification, the terms "inner," "interior," "outer," "exterior," "front," "back," "lower," "bottom," "upper," and "top" indicate orientations determined in relation to fully erected and upright cartons.

Figure 1:
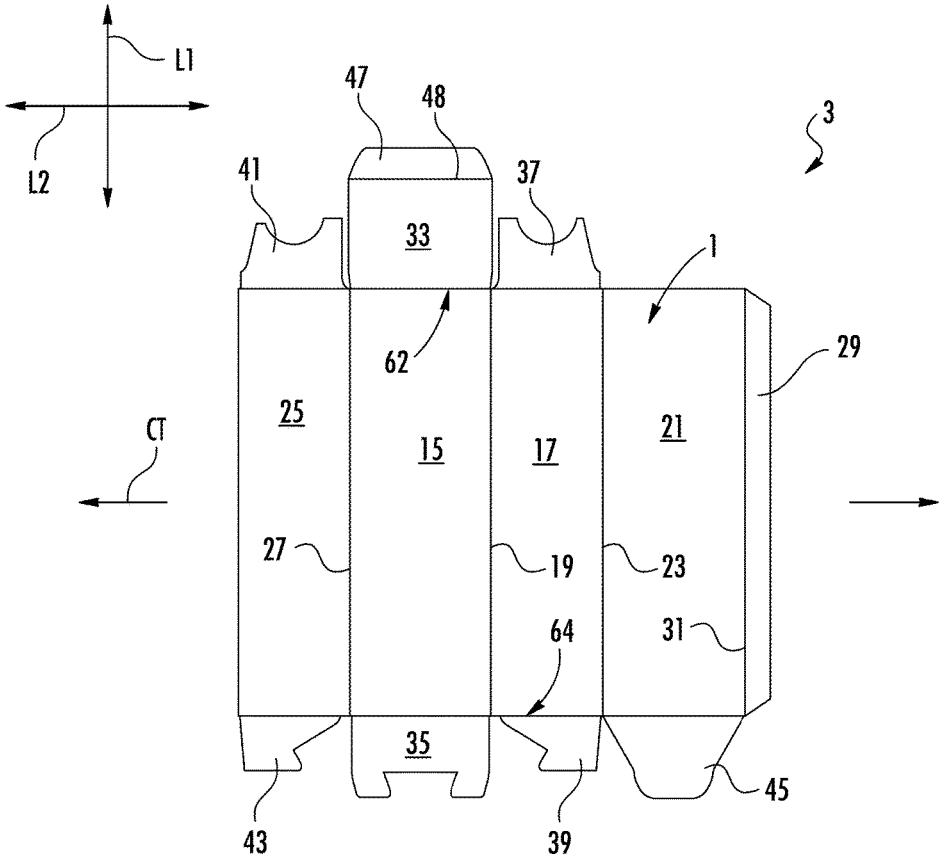
FIG. 1 is a plan view of a carton blank used to form a carton according to a first exemplary embodiment of the disclosure.

FIG. 1 is a plan view of the interior side 1 of a carton blank, generally indicated at 3, used to form a carton 5 (FIGS. 6A and 6B) according to the first exemplary embodiment of the disclosure. The carton 5 can be used to house an article such as a container C (FIGS. 5A and 5B). In one embodiment, the container C generally can be a bottle (e.g., a wine or liquor bottle). Alternatively, the article could be any suitable shape and/or size. In the illustrated embodiment, the carton 5 is sized to house one container C, but it is understood that the carton 5 may be sized and shaped to hold containers of a different or same quantity in more than one layer and/or in different row/column arrangements (e.g., 1×2, 2×2, 1×6, 3×6, 2×6×2, 3×5, 4×5, 2×9, 2×6, 4×4, etc.). In the illustrated embodiment, the carton 5 includes a spacer insert 12 (FIG. 4) that reinforces and stabilizes the container in the carton and that can help retain the containers in a central portion of the interior of the carton, spaced apart from the sides of the carton.

The carton blank 3 has a longitudinal axis L1 and a lateral axis L2. The carton blank 3 can include a lateral centerline CT, as shown in FIG. 1. In the illustrated embodiment, the blank 3 comprises a back panel 15 foldably connected to a first side panel 17 at a first longitudinal fold line 19. A front panel 21 is foldably connected to the first side panel 17 at a second longitudinal fold line 23. A second side panel 25 is foldably connected to the back panel 15 at a third longitudinal fold line 27. An attachment flap 29 is foldably connected to the back panel 21 along a fourth longitudinal fold line 31. Any of the front panel 15, the back panel 21, the first and second side panels 17, 25, and the attachment flap 29 could be omitted or could be otherwise shaped, arranged, positioned, and/or configured without departing from the disclosure. For example, the attachment flap 29 could be foldably connected to the second side panel 25. In an alternative embodiment, the attachment flap 29 could be omitted, and the blank could include two panels (e.g., two front panels) that are overlapped when the carton is formed.

The back panel 15 is foldably connected to a first top end flap 33 and a first bottom end flap 35. The first side panel 17 is foldably connected to a second top end flap 37 and a second bottom end flap 39. The second side panel 25 is foldably connected to a third top end flap 41 and a third bottom end flap 43. The front panel 21 is foldably connected to a fourth bottom end flap 45. In the illustrated embodiment, a tuck-in flap 47 can be foldably connected to the first top panel 33 along a lateral fold line 48. When the carton 5 is erected, the top end flaps 33, 37, 41 close a top end 7 of the carton, and the bottom end flaps 35, 39, 43, 45 close a bottom end 9 of the carton. In accordance with an alternative embodiment of the present disclosure, different flap arrangements can be used for at least partially closing the ends 7, 9 of the carton 5.

In one embodiment, the top end flaps 33, 37, 41 extend along a first marginal area of the blank 3 and are foldably connected at a first lateral fold line 62 that extends along the width of the blank. In the illustrated embodiment, the bottom end flaps 35, 39, 43, 45 extend along a second marginal area of the blank 3 and are foldably connected at a second lateral fold line 64 that also extends along the width of the blank. The lateral fold lines 62, 64 may be, for example, substantially straight, or offset at one or more locations to account for blank thickness or for other factors. The lateral fold lines 62, 64 could be omitted or could be otherwise shaped, arranged, positioned, and/or configured without departing from the disclosure.

Figure 2:
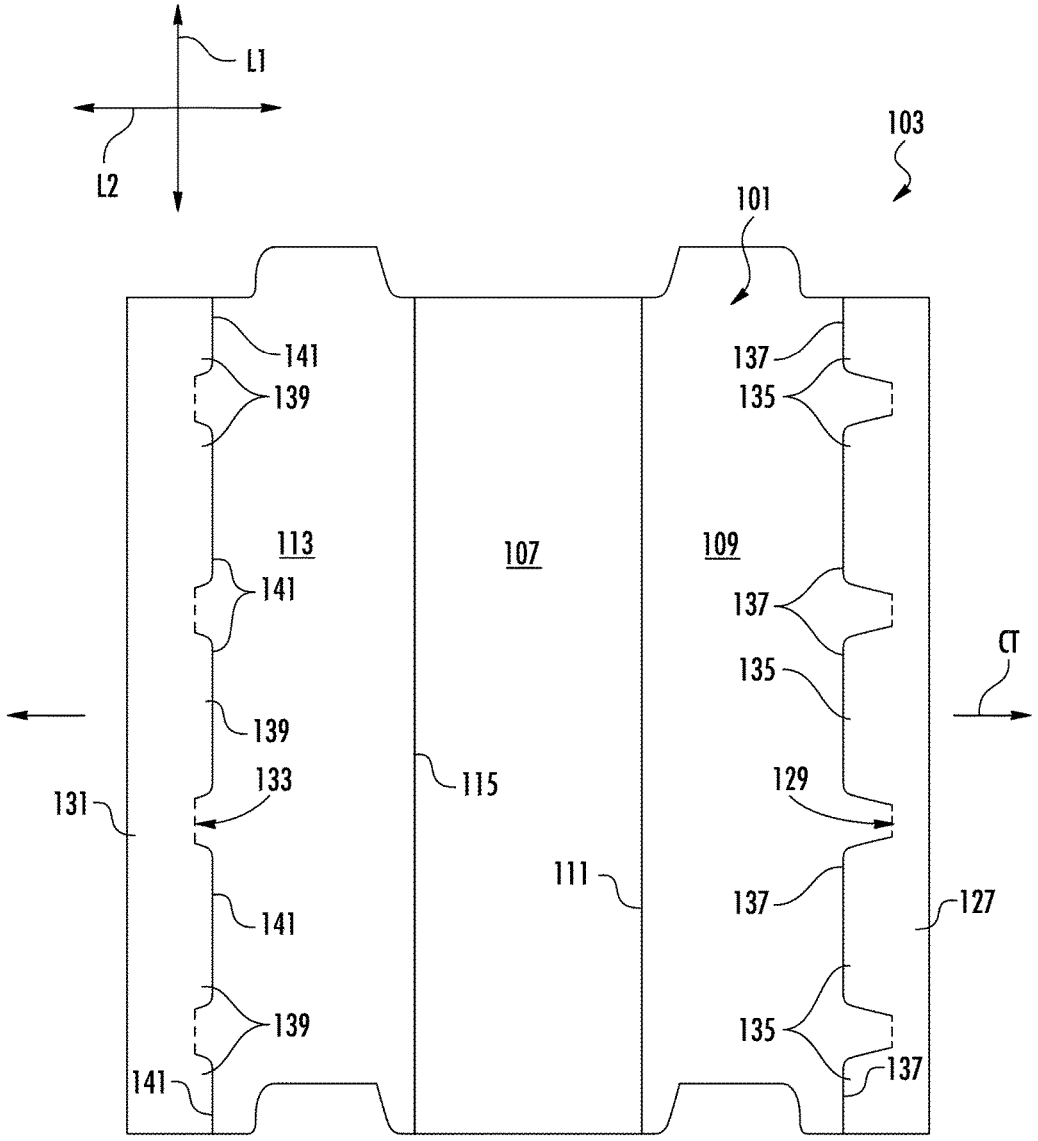
FIG. 2 is a plan view of an insert blank according to the first exemplary embodiment of the disclosure.

FIG. 2 illustrates an interior surface 101 of an insert blank 103 used to form the spacer insert 12 (FIGS. 4, 5A, and 5B) for use in the carton 5 according to the exemplary embodiment of the disclosure. The insert blank 103 could be any suitable material (e.g., corrugated cardboard, paperboard, and/or other materials). In one embodiment, the insert blank 103 can be a different material than the carton blank 3. For example, the insert blank material could be a less expensive, uncoated, unprinted paperboard, and the carton blank material could be a relatively more expensive paperboard that is coated and/or printed on at least one side. The insert blank material and the carton blank material could be other suitable materials without departing from the disclosure. Additionally, the insert blank material and the carton blank material could be the same material without departing from the disclosure.

As shown in FIG. 2, the insert blank has a longitudinal axis L1 and a lateral axis L2. In the illustrated embodiment, the insert blank 103 includes a central panel 107, a first inner side panel 109 foldably connected to the central panel 107 along a longitudinal fold line 111, and a second inner side panel 113 foldably connected to the central panel 107 along a longitudinal fold line 115. In the illustrated embodiment, a first inner or end flap 127 is foldably connected to the first inner side panel 109 along a longitudinal fold line 129, and a second inner or end flap 131 is foldably connected to the second inner side panel 113 along a longitudinal fold line 133. As shown in FIG. 2, the first end flap 127 includes several tabs 135, interrupting the longitudinal fold line 129. The tabs 135 can be separable from the first inner side panel 109 along respective tear or cut lines 137 (e.g., generally U-shaped cut lines). Similarly, the second end flap 131 includes several tabs 139, which interrupt the longitudinal fold line 133. The tabs 139 can be separable from the second inner side panel 113 along respective tear or cut lines 141 (e.g., generally U-shaped cut lines). The tabs 135, 139 at the ends of the end flaps 127, 131 generally are shorter than the tabs extending along the middle portions of the end flaps 127, 131 in the illustrated embodiment. In an alternative embodiment, the insert blank 103 can include any suitable number of tabs 135, 139. The insert blank 103 could be omitted or could be otherwise shaped, arranged, positioned, and/or configured without departing from the disclosure. For example, one or more of the tabs 135, 139 could be replaced by openings or other features.

Figure 3:
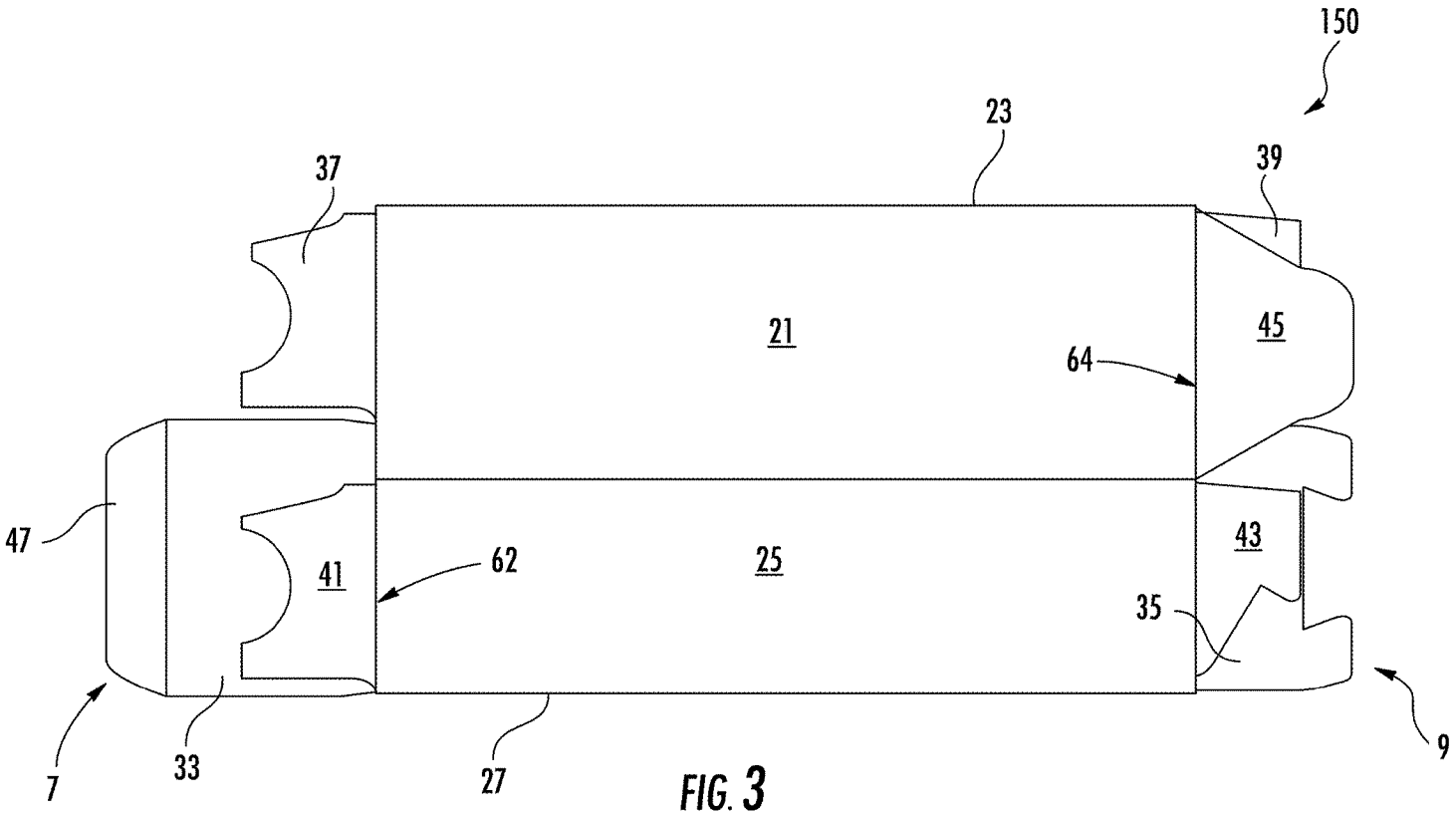
FIGS. 3 and 4 are perspective views of a partially formed carton and insert according to the first exemplary embodiment of the disclosure.
Figure 4:
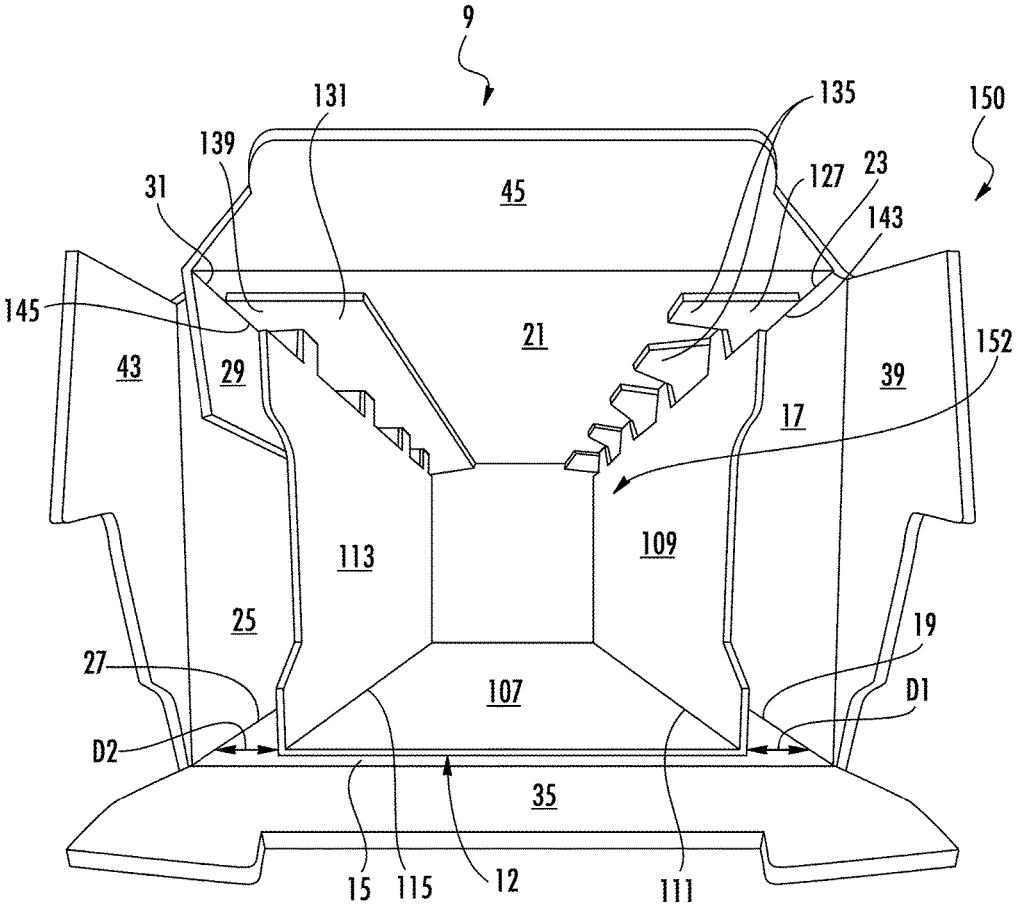
Figure 5A:
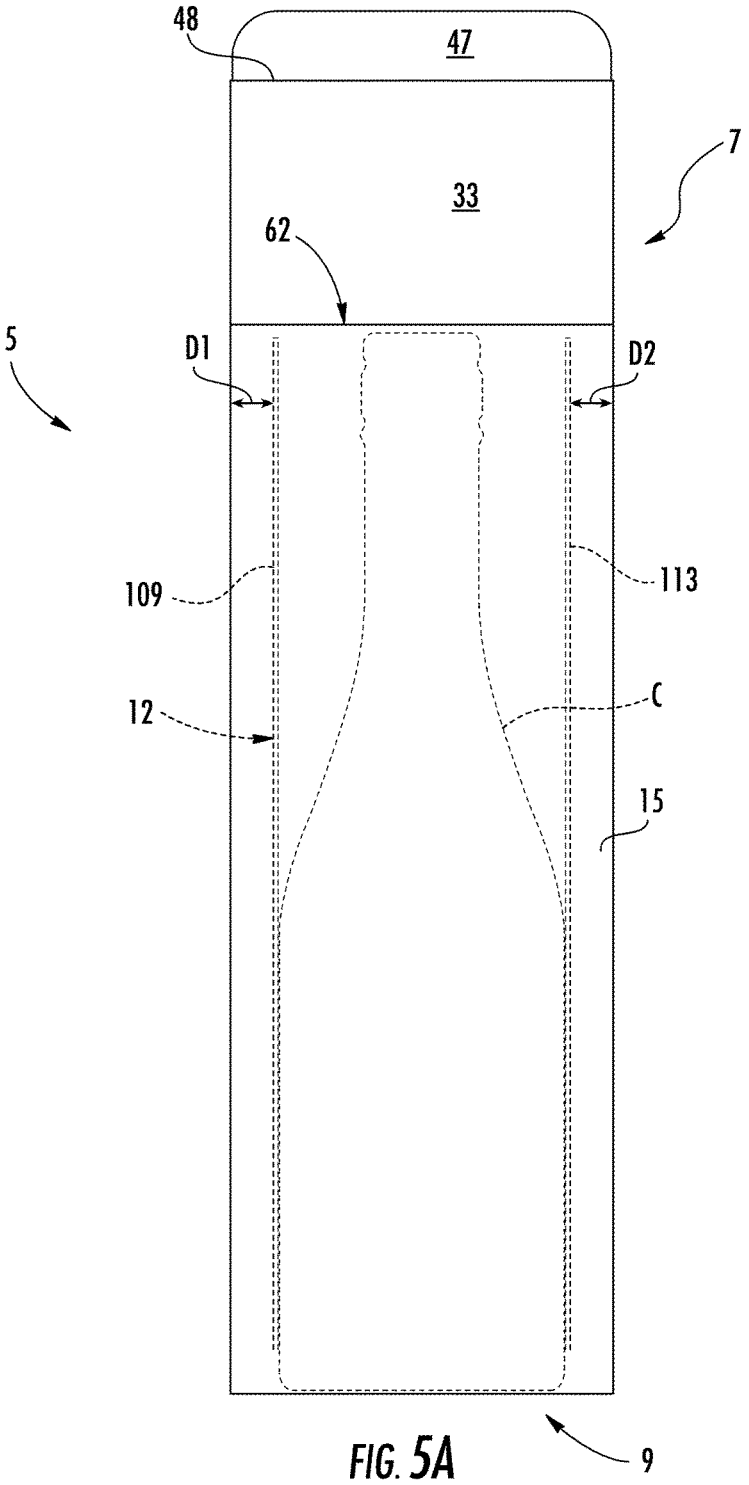
FIG. 5A is a side view of the partially formed carton showing the insert and an article in phantom according to the first exemplary embodiment of the disclosure.
Figure 5B:
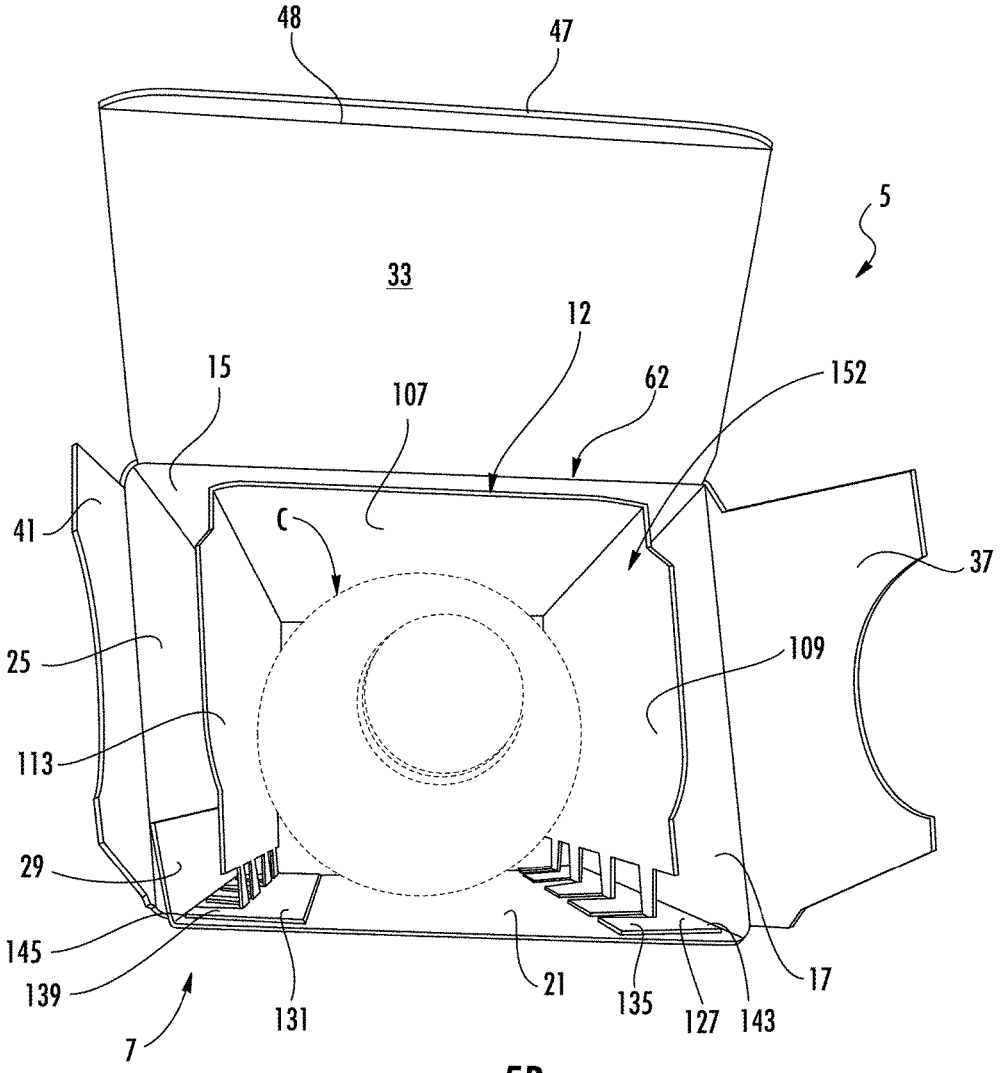
FIG. 5B is a top perspective view of the partially formed carton of FIG. 5A showing the insert and the article in the interior of the carton.

As shown in FIGS. 3 and 4, in one exemplary embodiment, the carton 5 and insert 12 can be assembled from the carton blank 3 and the insert blank 103. In the illustrated embodiment, the carton 5 can be formed by folding the panels 15, 17, 21, 25 along the longitudinal fold lines 19, 23, 27, 31 and attaching the attachment flap 29 to the interior surface of the second side panel 25 (e.g., by gluing) to form an open-ended sleeve 150 (FIGS. 3 and 4). In one embodiment, the glued attachment flap 29 and side panel 25 can generally cooperate to form the second side panel in the sleeve 150 and the carton 5. The sleeve 150 can be folded flat as shown in FIG. 3, or can be opened to form an interior 152 with the front panel 21 disposed opposite the back panel 15 and the side panels 17, 15 disposed opposite on another as shown in FIG. 4. The sleeve 150 could be otherwise formed without departing from the disclosure.

In one embodiment, the insert 12 can be formed by folding the insert blank 103 along longitudinal fold lines 111, 115, 129, 133 so that the inner side panels 109, 113 extend generally perpendicular with respect to the central panel 107 and the end flaps 127, 131 are generally perpendicular to the inner side panels 109, 113 (FIG. 4). In one embodiment, the end flap 127 can be folded along the fold line 129 so that the tabs 135 extend inwardly, and the end flap 131 can be folded along the fold line 133 so that the tabs 139 extend outwardly, as shown in FIG. 4. As shown in FIG. 4, the insert 12 can be inserted into the sleeve 150 so that the end flaps 127, 131 are in face-to-face contact with the front panel 21 and the central panel 107 is in face-to-face contact with the back panel 15. In one embodiment, the end flaps 127, 131 could be at least partially glued to the front panel 21 and/or the central panel 107 could be at least partially glued to the back panel 15 to help secure the insert 12 in the interior 152 of the open-ended sleeve 150 and the carton 5. In an alternative embodiment, the insert 12 could be otherwise oriented (e.g., the end flaps 127, 131 in face-to-face contact with the back panel 15 or one of the side panels 17, 25) and/or the end flaps 127, 131 and/or the central panel 107 could be spaced apart from the panels 15, 17, 21, 25.

In one embodiment, the insert 12 could be formed along with the open-ended sleeve 150 (e.g., the end flaps 127, 131 could be glued in face-to-face contact with the front panel 21 of the blank 3, or the central panel 107 could be glued in face-to-face contact with the back panel 15, and the sleeve 150 could be formed around the insert 12). For example, the end flaps 127, 131 could be glued to the front panel 21 of the blank 3, and the blank could be folded along the longitudinal fold lines 19, 23, 27, 31 to position the back panel 15 in overlapping relationship with the central panel 107. In one embodiment, the central panel 107 is glued to the back panel 15. The attachment flap 29 can be glued to the interior surface of the second side panel 25 to form the open-ended sleeve 150 (FIGS. 3 and 4). The open-ended sleeve 150 and/or the insert 12 could be otherwise formed without departing from the disclosure.

As shown in FIGS. 4, 5A, and 5B, the inner side panels 109, 113 can be spaced apart from the side panels 17, 25. For example, the inner side panel 109 can be spaced apart from the side panel 17 by a distance D1 (e.g., approximately the distance between the fold line 129 and the outer edge 143 of the end flap 127), and the inner side panel 113 can be spaced apart from the side panel 25 by a distance D2 (e.g., approximately the distance between the fold line 133 and the outer edges 145 of the tabs 139). In the illustrated embodiment, the distances D1, D2 are generally equal. Alternatively, the distances D1, D2 could be different. As shown in FIG. 4, the outer edge 143 of the end flap 127 can be disposed adjacent the side panel 17, the outer edges 145 of the tabs 139 can be disposed adjacent the side panel 25 (e.g., the combination of the side panel 25 and the attachment flap 29), and the inner side panels 109, 113 can be generally parallel to the side panels 17, 25. In an alternative embodiment, the outer edges 143, 145 could be spaced apart from the side panels 17, 25 and/or the inner side panels 109, 113 could be oblique with respect to the side panels 17, 25 and/or the central panel 107. The insert 12 could be otherwise formed and/or inserted into the sleeve 150 without departing from the scope of the disclosure.

Figure 6A:
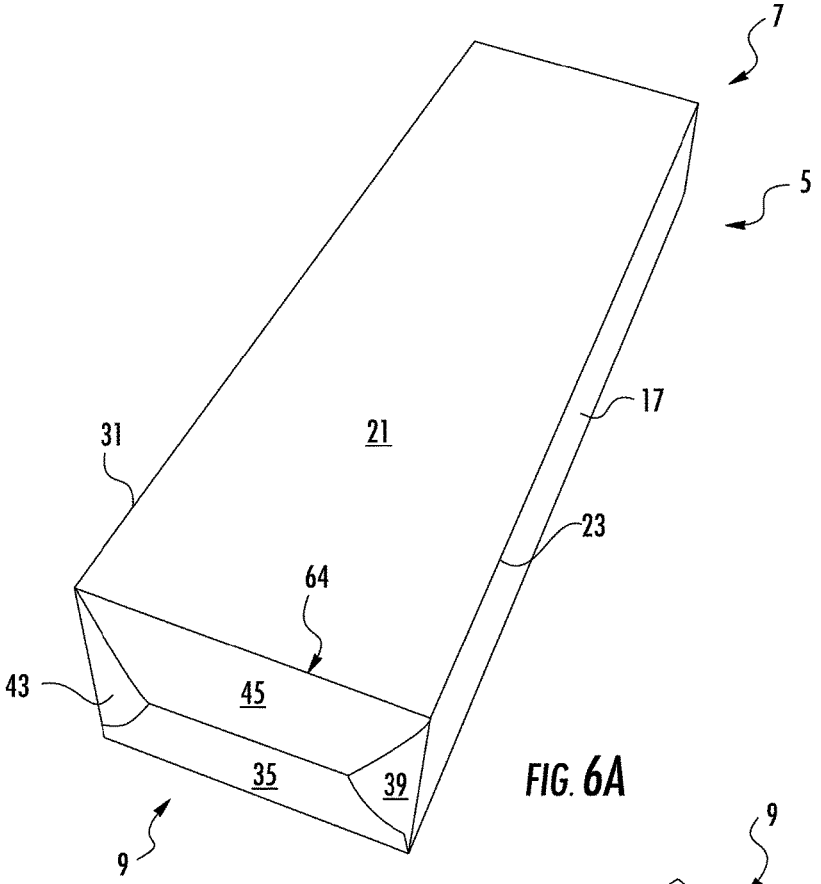
FIGS. 6A and 6B are perspective views of the erected carton according to the first exemplary embodiment of the disclosure.

As shown in FIG. 3, the sleeve 150 and insert 12 can be collapsed into a flattened configuration, such as by folding the sleeve 150 along fold lines 19, 23, 27, 31 and the insert 12 along fold lines 111, 115, 129, 133. The flattened configuration can be convenient for storage and/or shipping of the carton 5. The carton 5 can be loaded with a container C by folding the open-ended sleeve 150 along fold lines 19, 23, 27, 31, 111, 115, 129, 133 to the opened configuration of FIG. 4 and closing the bottom end 9 (FIGS. 5A and 6A). The bottom end 9 can be closed, in one embodiment, by folding the bottom end flaps 35, 39, 43, 45 along the fold line 64 to overlap and interlock the bottom end flaps (FIG. 6A). In one embodiment, the bottom end flaps could be glued together. As shown in FIGS. 5A and 5B, a container C can be inserted into the interior 152 of the sleeve 150 and the insert 12 through the open top end 7. Accordingly, as shown in FIGS. 5A and 5B, the container C can be retained by at least the inner side panels 109, 113, the central panel 107, the front panel 21, and the closed bottom end 9, wherein the side panels 17, 25 are spaced apart from the inner side panels 109, 113 and the container C by the respective distances D1, D2.

Figure 6B:
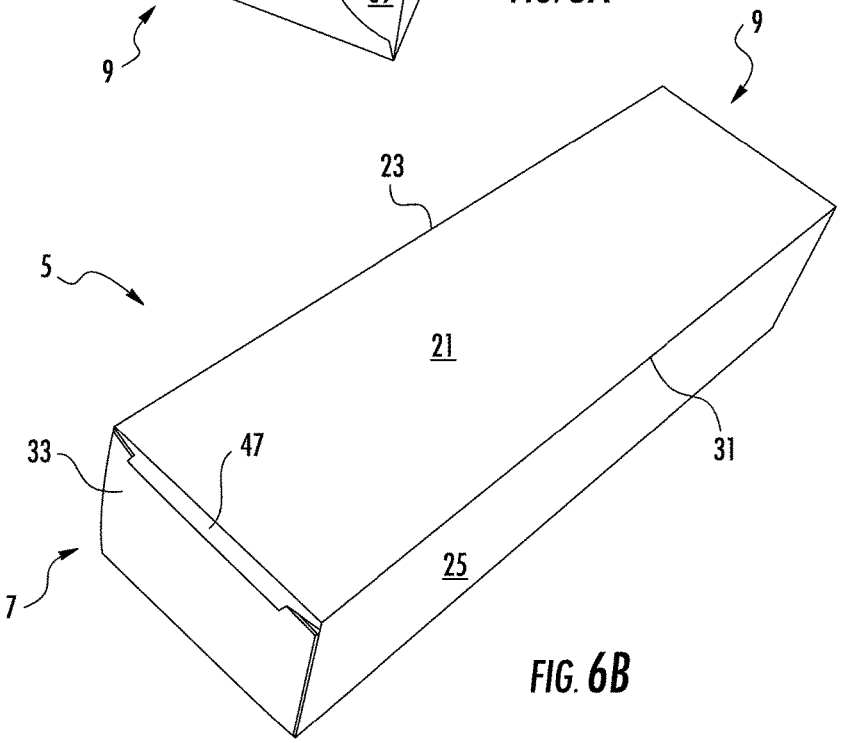

As shown in FIG. 6B, the top end 7 can be closed by folding the top end flaps 37, 41 along the fold line 62, and folding the top end flap 33 along the fold line 62 to overlap the top end flaps 37, 41. In the illustrated embodiment, the tuck-in flap 47 can be folded along the fold line 48 and inserted into the interior 152 of the sleeve 150 between the front panel 21 and the top end flaps 37, 41. The carton 5 could be loaded and/or the ends 7, 9 could be closed by other steps without departing from the disclosure. Additionally, other closing and loading sequences can be used without departing from the disclosure.

The erected carton 5 according to the illustrated embodiment is shown in FIGS. 5A and 5B. The insert 12 can retain the container C in the carton 5 while the outer carton is larger than the container (e.g., the side panels 17, 25 are wider than the bottle). Accordingly, an outer carton that is larger than the container can be used for a larger presence on a store shelf or for larger surface for printed material, for example, while the insert 12 retains the container C in the interior 152 of the carton 5.

Figure 7:
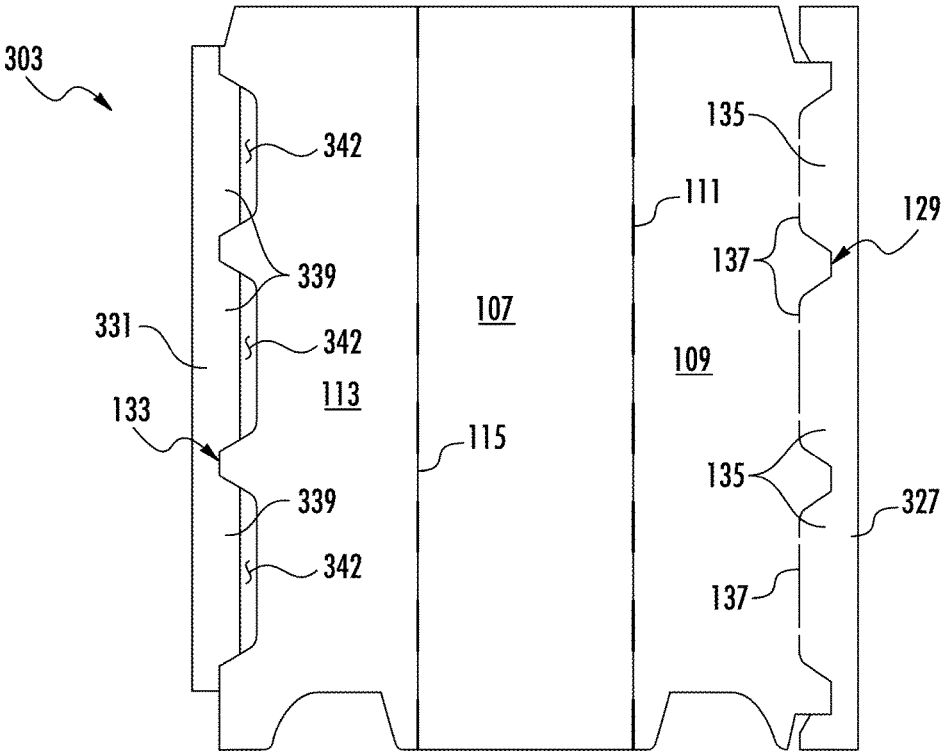
FIG. 7 is a plan view of an insert blank according to a second exemplary embodiment of the disclosure.
Figure 8:
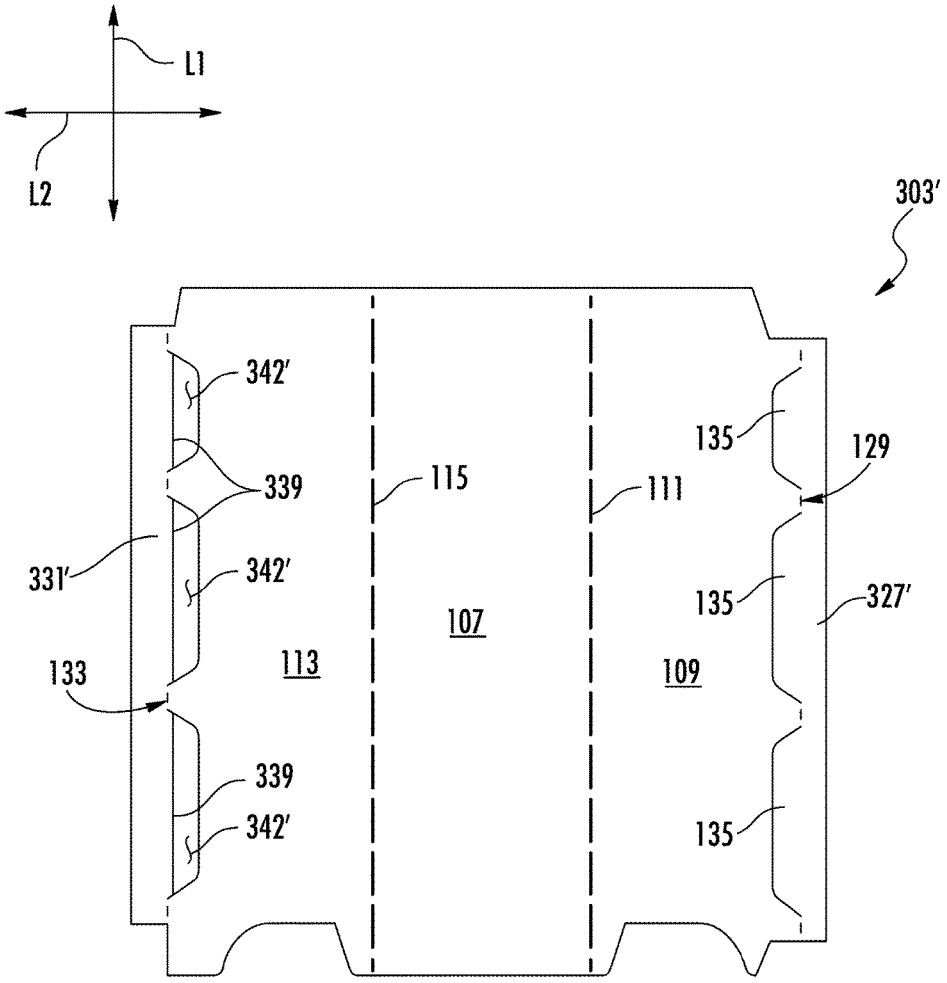
FIG. 8 is a plan view of an insert blank according to an alternative embodiment of the disclosure.

FIG. 7 is a plan view of an insert blank 303 for forming an insert (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 7, the insert blank 303 is generally similar to the insert blank 103 of the first embodiment, except the insert blank 303 has a slightly different shape. For example, the first end flap 327 has a different shape than the first end flap 127 of the first embodiment. Additionally, the second end flap 331 as shown in FIG. 7 is similar to the second end flap 131 of the first embodiment, except that the tabs 339 of the second end flap 331 extend adjacent respective openings 342 (e.g., the tabs 339 are spaced from a portion of the second inner side panel 113 by the openings 342). The insert blank 303 could be otherwise shaped, arranged, positioned, and/or configured without departing from the disclosure. For example, in an alternative embodiment shown in FIG. 8, the insert blank 303' can be generally similar to the insert blank 303 except that the end flaps 327', 331' and the openings 342' can have generally different shapes than the end flaps 327, 331 and the openings 342 of FIG. 7.

Figure 9:
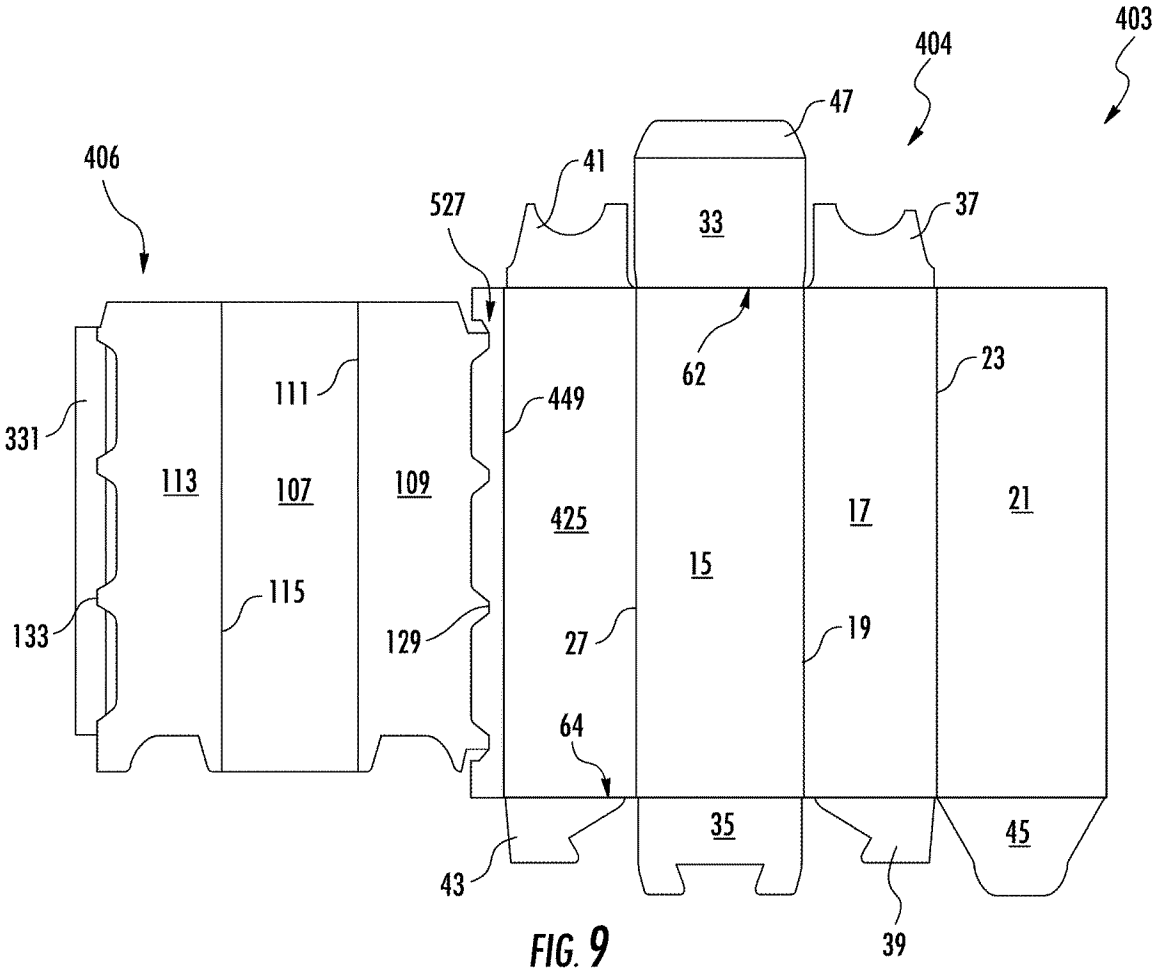
FIG. 9 is a plan view of a blank used to form a carton according to a third exemplary embodiment of the disclosure.

FIG. 9 is a plan view of a blank 403 for forming carton with an integrated spacing feature (not shown) according to a third embodiment of the disclosure showing exemplary dimensions. The third embodiment is generally similar to the first embodiment, except for variations noted and variations that will be apparent to one of ordinary skill in the art. Accordingly, similar or identical features of the embodiments have been given like or similar reference numbers. As shown in FIG. 9, the blank 403 has a first (e.g., outer) portion 404 and a second (e.g., inner) portion 406. In the illustrated embodiment, the outer portion 404 is generally the same as the carton blank 3 of the first embodiment without the attachment flap 29. Accordingly, the outer portion 404 forms an outer carton (not shown) similar to the outer carton 5 of the first embodiment. The inner portion 406 is generally the same as the insert blank 303 of the second embodiment and forms an integrated spacing feature (not shown) in the interior of the outer carton formed by the outer portion 404. The integrated spacing feature can be generally similar to the insert 12 of the first embodiment (e.g., FIGS. 4, 5A, and 5B). In the illustrated embodiment, the end flap 527 of the inner portion 406 is foldably connected to the second side panel 425 of the outer portion 404 along a longitudinal fold line 449. In one embodiment, the outer portion 404 could be considered a carton blank and the inner portion 406 could be considered an insert blank, wherein the insert blank is foldably connected to the carton blank along a fold line (e.g., fold line 449). The blank 403 could be otherwise shaped, arranged, and/or configured without departing from the disclosure. For example, the inner portion 406 could be foldably connected to the front panel 21 in an alternative embodiment.

In one embodiment, a carton with an integrated spacing feature (not shown) can be formed by the blank 403 by folding the blank along the longitudinal fold line 449 so that the inner portion 406 is in face-to-face contact with the outer portion 404. In one embodiment, the central panel 107 can be glued to the back panel 15. The blank can be folded along the longitudinal fold lines 19, 23, 27, 111, 115, 129, 133 and the end flaps 331, 527 can blue glued in face-to-face contact with the front panel 21 to form an open-ended sleeve (not shown) with the inner portion 406 disposed within the outer portion 404. The sleeve can look similar to the sleeve 150 of the first embodiment shown in FIG. 4 except that the attachment flap 29 is omitted and the end flap 527 is foldably connected to the second side panel 425. Additionally, the integrated spacing feature would have an opposite orientation than the insert 12 of the first embodiment shown in FIG. 4 so that the inner side panel 109 is proximate the second side panel 425 and the inner side panel 113 is proximate the first side panel 17. The carton could be loaded and closed as shown in described in the first embodiment. The carton could be formed, loaded, and/or closed by other steps without departing from the disclosure. Additionally, other forming, closing, and/or loading sequences can be used without departing from the disclosure.

Figure 10:
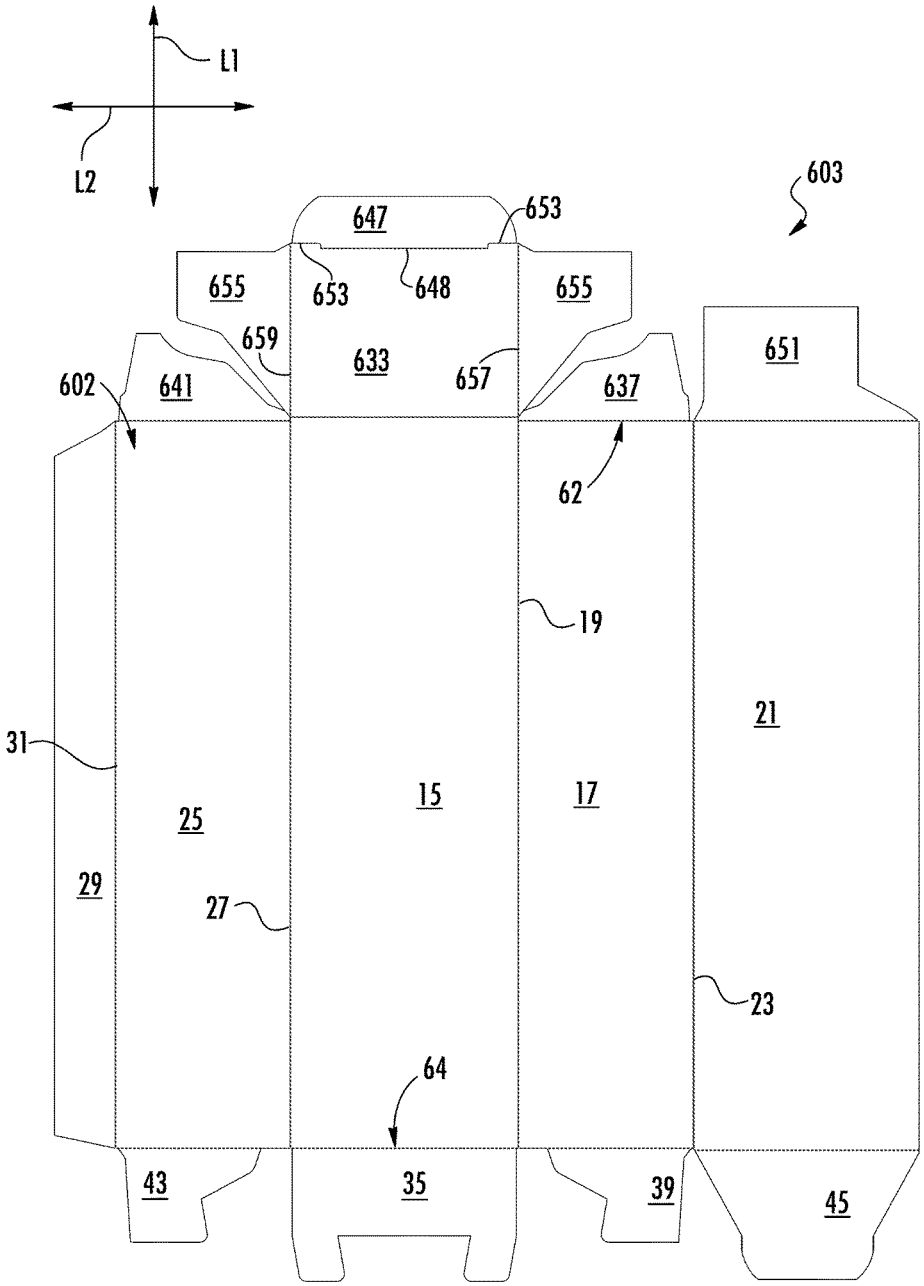
FIG. 10 is a plan view of a carton blank used to form a carton according to a fourth exemplary embodiment of the disclosure.
Figure 11:
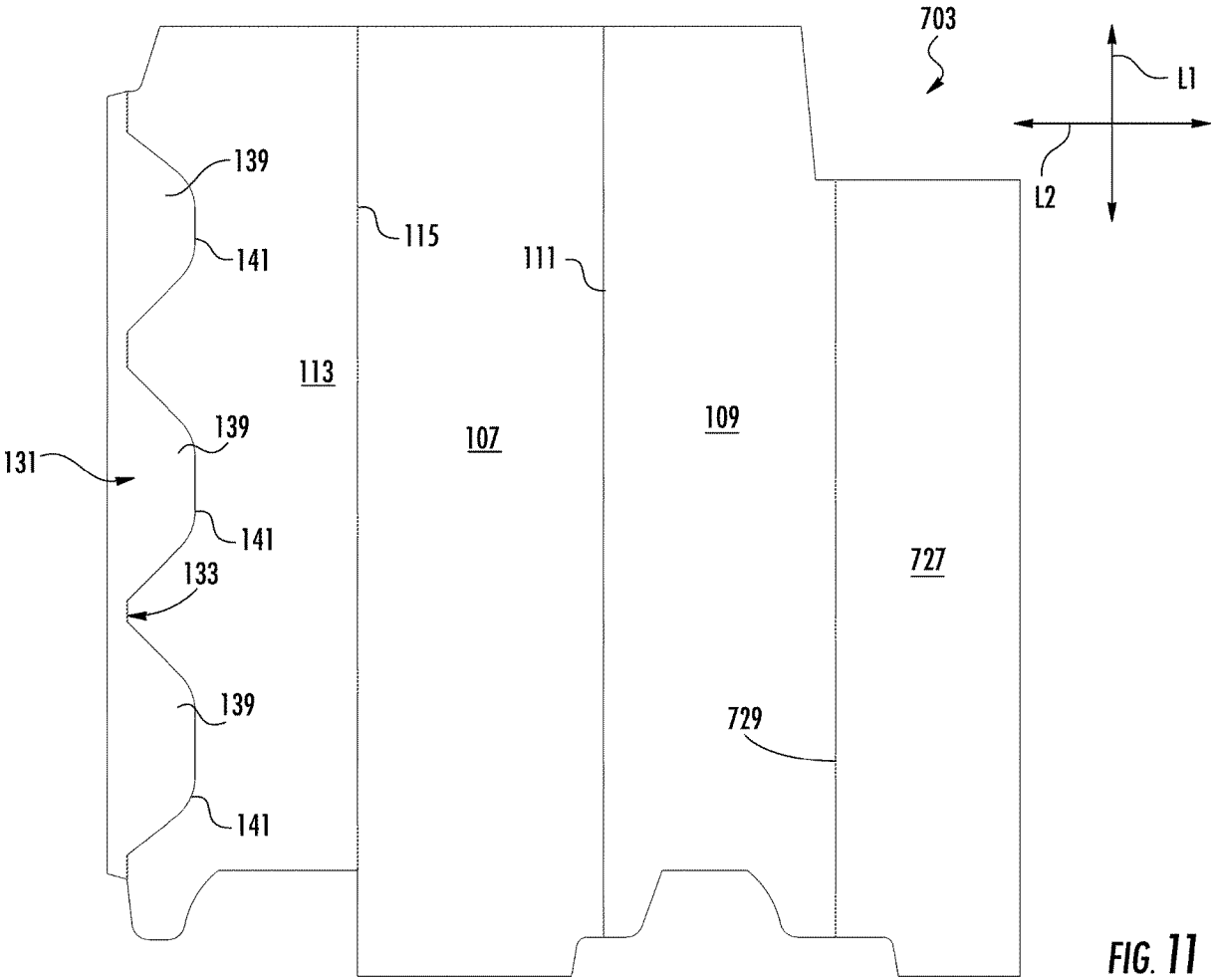
FIG. 11 is a plan view of an insert blank according to the fourth exemplary embodiment of the disclosure.

FIG. 10 is a plan view of an exterior side 602 of a carton blank 603 for forming carton 605 (FIG. 14) according to a fourth embodiment of the disclosure. FIG. 11 is a plan view of an insert blank 703 for forming a spacer insert 612 (FIG. 13) in the carton 605 according to the fourth embodiment of the disclosure. The fourth embodiment is generally similar to the previous embodiments, except for variations noted and variations that will be apparent to one of ordinary skill in the art. Accordingly, similar or identical features of the embodiments have been given like or similar reference numbers. As shown in FIG. 10, the carton blank 603 is similar to the carton blank 3 of the first embodiment except that the attachment flap 29 is foldably connected to the second side panel 25 along the fold line 31 instead of being foldably connected to the front panel 21. In the fourth embodiment, the carton blank 603 can include a top panel 633 and top end flaps 637, 641, 651 extending along a top marginal area of the blank 603 and are foldably connected along the lateral fold line 62. As shown in FIG. 10, the top panel 633 is foldably connected to the back panel 15 and the top end flaps 637, 641, 651 are respectively foldably connected to the first side panel 17, the second side panel 25, and the front panel 21. In the illustrated embodiment, the top end flap 637, 641 are generally similar to the top end flap 37, 41 of the first embodiment, but having a different shape.

In the illustrated embodiment, a tuck-in flap 647 is foldably connected to the top panel 633 along a lateral fold line 648. The tuck-in flap 647 and the fold line 648 are similar to the tuck-in flap 47 and the fold line 48 of the first embodiment, except that the fold line 48 extends a portion of the width of the top panel 633 with two cuts 653 extending from the ends of the fold line 648 as shown in FIG. 10. In the illustrated embodiment, the top panel 633 extends outwardly from the fold line 648 so that the fold line 648 and the tuck-in flap 647 are inset from the outer edge of the top panel 633 when the tuck-in flap 647 is folded with respect to the top panel 633. The carton blank 603 can also include two top end flaps 655 foldably connected to the top panel 633 along respective longitudinal fold lines 657, 659. In the illustrated embodiment, the fold lines 657, 659 can be generally collinear with the respective fold lines 19, 27. The carton blank 603 could be otherwise shaped, arranged, positioned, and/or configured without departing from the disclosure.

As shown in FIG. 11, the insert blank 703 is similar to the insert blank 103 of the first embodiment except that the insert blank 703 has a different shape than the insert blank 103. Also, the first end flap 127 is replaced by an inner end panel 727, which is foldably connected to the first inner side panel 109 along a longitudinal fold line 729. The insert blank 703 could be otherwise shaped, arranged, positioned, and/or configured without departing from the disclosure.

Figure 12:
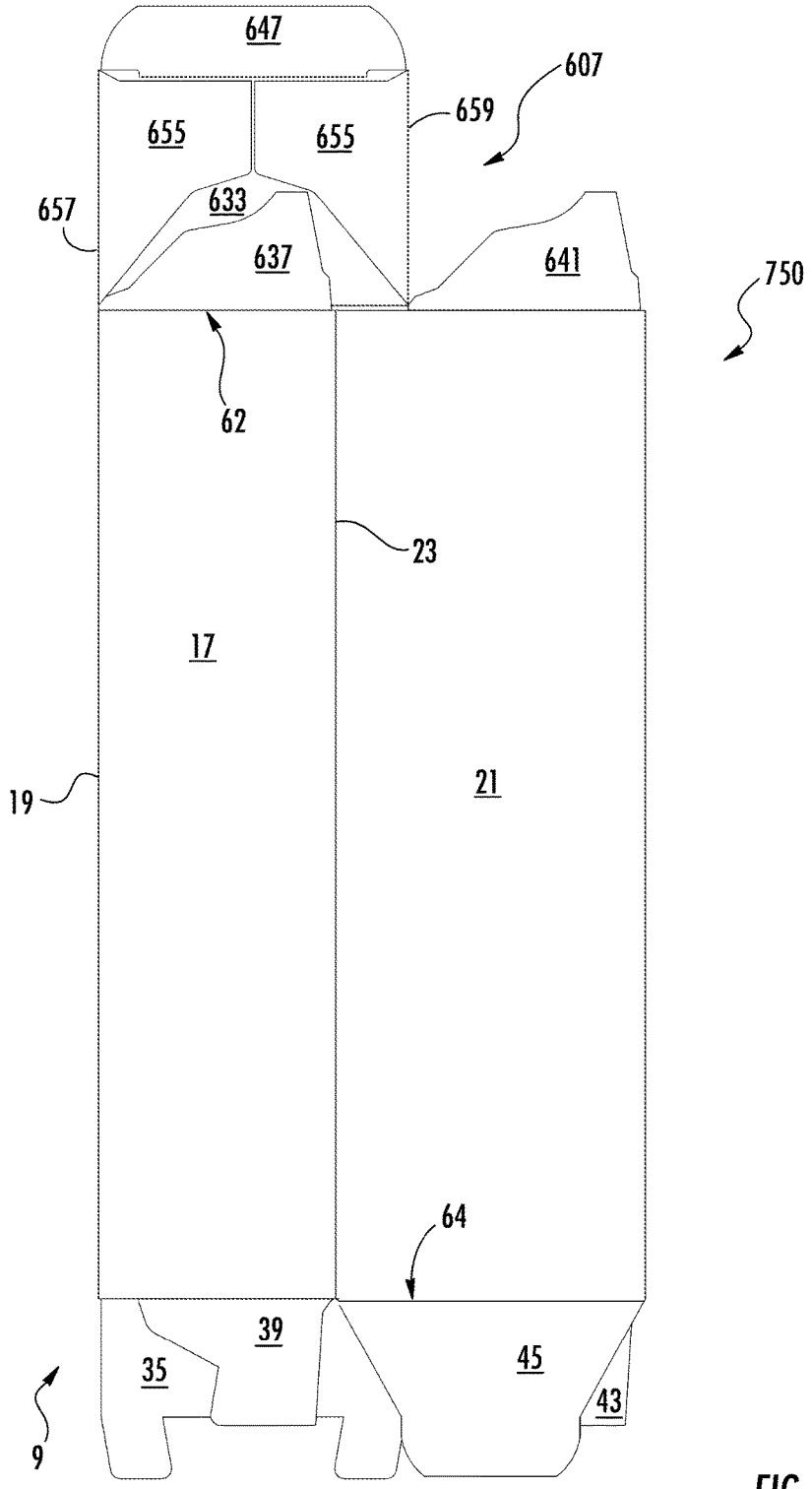
FIG. 12 is a plan view of a partially formed carton and insert according to the fourth exemplary embodiment of the disclosure.
Figure 13:
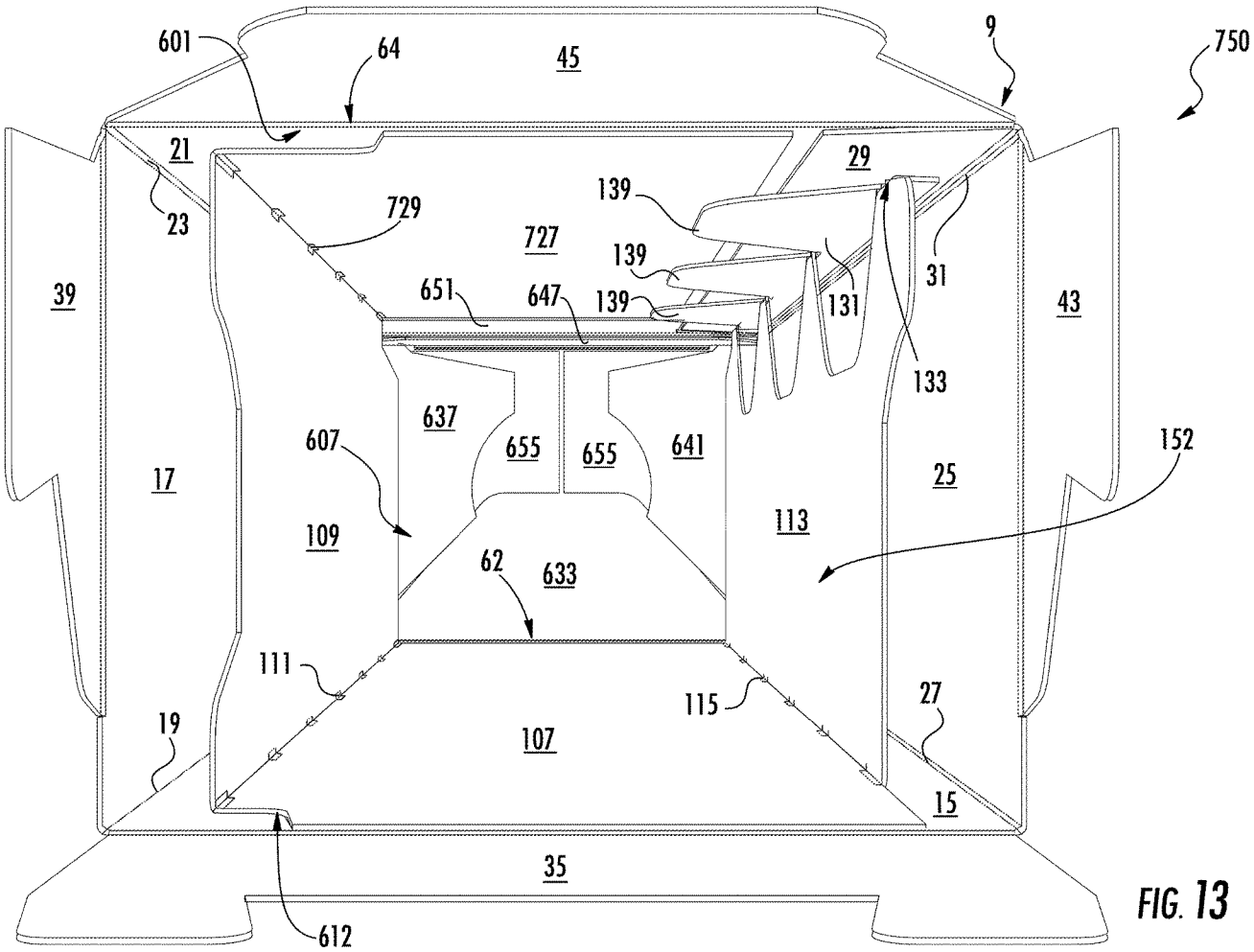
FIG. 13 is an interior perspective view of a partially formed carton and insert according to the fourth exemplary embodiment of the disclosure.

As shown in FIGS. 12 and 13, the insert blank 703 and the carton blank 603 can be assembled into the carton 605 similarly to the assembly of the carton blank 3 and the insert blank 103 into the carton 5 of the first embodiment. The partially formed carton 750 shown in FIGS. 12 and 13 can be formed by attaching (e.g., gluing) the attachment flap to the interior surface 601 of the front panel 21. The insert 612 can be formed by folding the panels 107, 109, 113, 727 and the end flap 131 relative to each other and the insert can be disposed in the interior 152 of the partially formed carton 750 (FIG. 13). In the illustrated embodiment, the insert 612 can be positioned so that the central panel 107 is in face-to-face contact with the back panel 15 and the end panel 727 is in face-to-face contact with the front panel 21. The first inner side panel 109 can extend between the panels 107, 727 and can be spaced apart from the side panel 17. As shown in FIG. 13, the end panel 727 can be generally coplanar with the attachment flap 29 and the attachment flap 29 and/or the end panel 727 can at least partially overlap (e.g., can be disposed in face-to-face contact with) the end flap 131.

In the illustrated embodiment, the inner side panel 113 can extend between the central panel 107 and the end flap 131 and can be spaced apart from the side panel 25. In one embodiment, the width of the inner side panel 113 is smaller than the width of the inner side panel 109 by the thickness of the end panel 727 and/or the thickness of the attachment flap 29. As shown in FIG. 13, the end flap 131 can be folded so that the tabs 139 are directed toward the interior 152 of the carton and the remainder of the end flap 131 extends at least partially from the inner side panel 113 to the side panel 25. In the illustrated embodiment, the tabs 139 can be at least partially in face-to-face contact with the end panel 727 and the attachment flap 29 and the remainder of the end flap 131 can be at least partially in face-to-face contact with the attachment flap 29. In one embodiment, the central panel 107 can be glued to the back panel 15, the end panel 727 can be glued to the front panel 21, and/or the end flap 131 can be glued to at least one of the attachment flap 29 and the end panel 727. In one embodiment, the overlapping and/or gluing of the end panel 727 and the attachment flap 29 to the end flap 131 can help add strength to the carton 605 (e.g., at the front face of the carton, which front face can include the front panel 21, the end panel 727, the attachment flap 29, and the end flap 131).

In one embodiment, the front panel 21 and the back panel 15 can be disposed opposite one another and the side panels 17, 25 can be disposed opposite one another when the carton 605 is erected. Similarly, as shown in FIG. 13, the inner end panel 727 can be disposed opposite to the central panel 107, the inner side panels 109, 113 can be disposed opposite one another, and the central panel 107 and/or the inner end panel 727 can be disposed generally parallel to the back panel 15 and/or the front panel 21 when the insert 612 is erected and disposed in the interior 152 of the carton 605. Further, in one embodiment, the inner side panels 109, 113 can be disposed generally parallel to and spaced apart from the side panels 17, 25. In addition, as shown in FIG. 13, the front panel 21 and the back panel 15 can overlap and/or be in face-to-face contact with the respective inner end panel 727 and central panel 107 in one embodiment. The insert 612 could be otherwise formed and/or could be otherwise shaped, arranged, positioned, and/or configured without departing from the disclosure. For example, the end flap 131 could be folded so that the tabs 139 extend outwardly from the inner side panel 113 toward the side panel 25.

As shown in FIGS. 12 and 13, the top end flap 651 can be folded into face-to-face contact with the interior surface 601 of the front panel 21, and, in one embodiment, the top end flap 651 can be glued to the front panel 21. In the illustrated embodiment, the insert 612 can include a cutout (e.g., along panels 109, 727 as shown in FIG. 11) to provide clearance for the folded top end flap 651. In one example, the top end flap 651 can help reinforce the front panel 21 at the top of the carton 605. In addition, the top end flaps 655 can be folded into face-to-face contact with the top panel 633, and, in one embodiment, the top end flaps 655 can be glued to the top panel 633.

Figure 14:
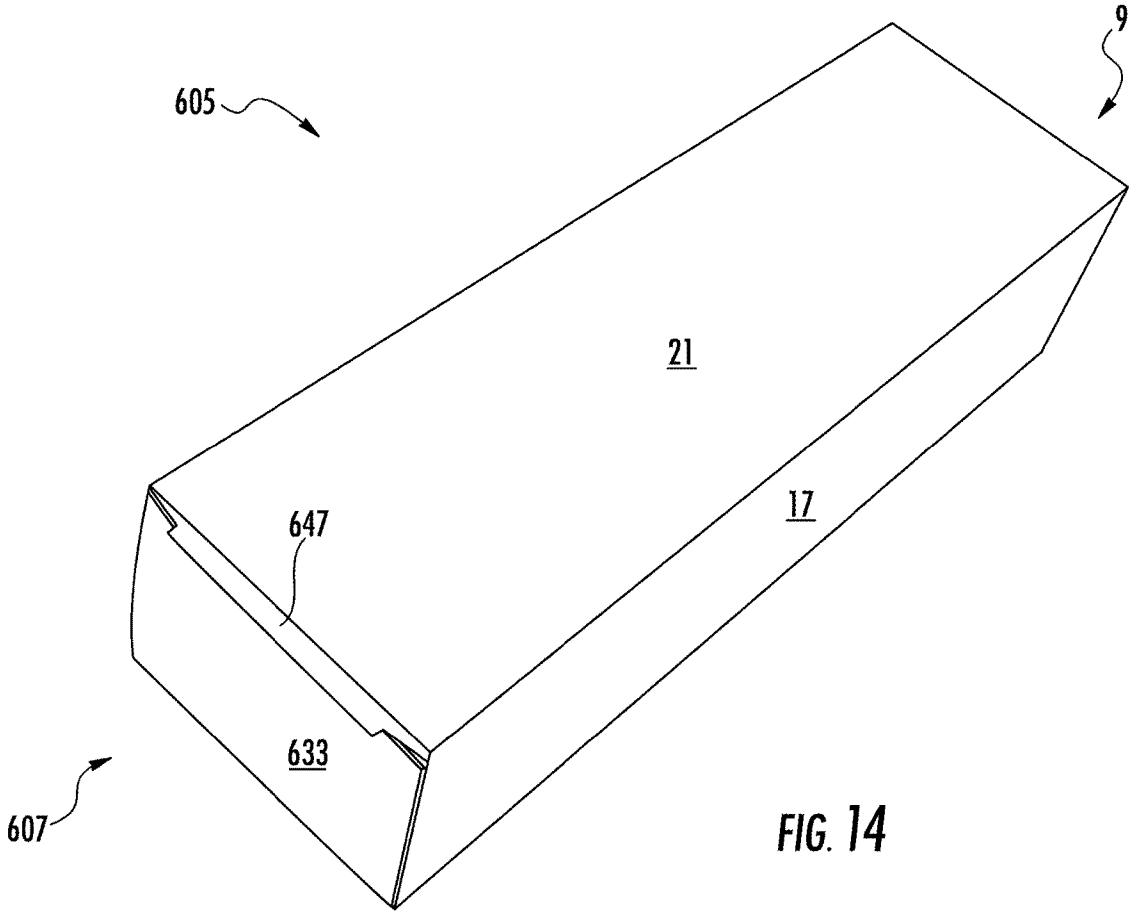
FIG. 14 is a perspective view of the erected carton according to the fourth exemplary embodiment of the disclosure.

As shown in FIGS. 13 and 14, the top end 607 of the carton can be closed by folding the top end flaps 637, 641 over the end of the sleeve, folding the top panel 633 over the top end flaps 637, 641, and folding the tuck-in flap 647 inwardly so that the tuck-in flap 47 slides against the top end flap 651. The erected carton 605 is shown in FIG. 14. The carton 605 could be otherwise formed without departing from the disclosure.

In one embodiment, the insert 612 (as well as the inserts and similar features of the prior embodiments) can generally hold the container C in a generally central position in the carton 605 and can add strength to the carton. For example, the insert 612 can increase the compression strength of the carton 605 by resisting damage due to squeezing the carton (e.g., at the top of the carton where the container C is narrower). The carton 605, including the insert 612, can be otherwise configured and/or can have additional benefits without departing from the disclosure.

Any of the features of the various embodiments of the disclosure can be combined with, replaced by, or otherwise configured with other features of other embodiments of the disclosure without departing from the scope of this disclosure. Further, it is noted that the reinforcing inserts and insert blanks of the various embodiments can be incorporated into a carton having any carton style or panel configuration. The carton styles and panel configurations described above are included by way of example.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding an article, the carton comprising:

a plurality of panels that extends at least partially around an interior of the carton, the plurality of panels comprising a first panel and a second panel; and an insert comprising a central panel, an inner end panel disposed generally opposite to the central panel, an inner side panel foldably connected to the central panel, and an inner flap foldably connected to the inner side panel, wherein the central panel extends generally parallel to the first panel, the inner side panel extends generally parallel to the second panel, the inner end panel at least partially overlaps the inner flap, the inner flap comprises a tab extending inwardly from the inner side panel and the inner flap comprises a portion extending outwardly from the inner side panel in a direction toward the second panel, the tab being at least partially in face-to-face contact with at least the inner end panel;

wherein the second panel is foldably connected to the first panel and to an attachment flap, and the inner flap is at least partially in face-to-face contact with each of the inner end panel and the attachment flap.

2. The carton of claim 1, wherein the plurality of panels further comprises a third panel, the first panel at least partially overlaps and is in at least partial face-to-face contact with the central panel, and the third panel at least partially overlaps and is in at least partial face-to-face contact with the inner end panel.

3. The carton of claim 2, wherein the inner side panel is spaced apart from the second panel.

4. The carton of claim 2, wherein the attachment flap is at least partially in face-to-face contact with the third panel.

5. The carton of claim 2, wherein the inner side panel is a first inner side panel, the insert further comprises a second inner side panel foldably connected to the central panel and to the inner end panel.

6. The carton of claim 5, wherein plurality of panels further comprises a fourth panel disposed generally opposite to the second panel, and each of the first inner side panel and the second inner side panel is spaced apart from each of the second panel and the fourth panel.

7. The carton of claim 1, wherein the inner side panel is spaced apart from the second panel and at least a portion of the inner flap extends from the inner side panel toward the second panel.

8. The carton of claim 7, wherein the inner flap further comprises at least one other tab extending inwardly from the inner side panel.

9. The carton of claim 1, further comprising at least one end flap foldably connected to a respective panel of the plurality of panels, the at least one end flap at least partially forming an at least partially closed end of the carton.

10. The carton of claim 9, wherein the carton is for at least partially receiving the article so that the article is at least partially retained by at least the closed end of the carton, the central panel, and the inner side panel.

11. The carton of claim 1, wherein the tab extends inwardly from the inner side panel in a first direction, and the portion of the inner flap extends outwardly from the inner side panel in a second direction, the second direction is opposite the first direction.

12. The carton of claim 1, wherein the tab and the portion of the inner flap are coplanar.

13. In combination, a carton blank and an insert blank for forming a carton for holding an article:

the carton blank comprising a plurality of panels comprising a first panel and a second panel; and the insert blank comprising a central panel, an inner end panel for being disposed generally opposite to the central panel when the carton is formed from the carton blank and the insert blank, an inner side panel foldably connected to the central panel, and an inner flap foldably connected to the inner side panel;

wherein the central panel is for extending generally parallel to the first panel when the carton is formed from the carton blank and the insert blank, the inner side panel is for extending generally parallel to the second panel when the carton is formed from the carton blank and the insert blank, and the inner end panel is for at least partially overlapping the inner flap when the carton is formed from the carton blank and the insert blank, the inner flap comprises a tab for extending inwardly from the inner side panel and the inner flap comprising a portion for extending outwardly from the inner side panel in a direction toward the second panel when the carton is formed from the carton blank and the insert blank, the tab for being disposed in at least partial face-to-face contact with at least the inner end panel when the carton is formed from the carton blank and the insert blank;

wherein the second panel is foldably connected to the first panel and to an attachment flap, and the inner flap is for being disposed at least partially in face-to-face contact with each of the inner end panel and the attachment flap when the carton is formed from the carton blank and the insert blank.

14. The combination of claim 13, wherein the plurality of panels further comprises a third panel, the first panel is for at least partially overlapping and for being in at least partial face-to-face contact with the central panel when the carton is formed from the carton blank and the insert blank, and the third panel is for at least partially overlapping and for being in at least partial face-to-face contact with the inner end panel when the carton is formed from the carton blank and the insert blank.

15. The combination of claim 14, wherein the attachment flap is for being disposed at least partially in face-to-face contact with the third panel when the carton is formed from the carton blank and the insert blank.

16. The combination of claim 14, wherein the inner side panel is a first inner side panel, the insert further comprises a second inner side panel foldably connected to the central panel and to the inner end panel.

17. The combination of claim 16, wherein plurality of panels further comprises a fourth panel foldably connected to the first panel and to the third panel, the fourth panel is for being disposed generally opposite to the second panel when the carton is formed from the carton blank and the insert blank, and the attachment flap is for being attached to the third panel when the carton is formed from the carton blank and the insert blank.

18. The combination of claim 13, wherein the inner flap is foldably connected to the inner side panel along a fold line, the inner flap further comprises at least one other tab, each tab interrupts the fold line and is at least partially defined by a cut line extending from respective ends of the fold line, and each of the tabs is at least partially separable from the inner side panel along the respective cut line.

19. The combination of claim 13, wherein the inner flap is foldably connected to the inner side panel along a fold line, the tab interrupts the fold line, and the tab is for being disposed at least partially in face-to-face contact with each of the inner end panel and the attachment flap when the carton is formed from the carton blank and the insert blank.

20. The combination of claim 13, wherein the carton blank further comprises at least one end flap foldably connected to a respective panel of the plurality of panels, the at least one end flap being for at least partially forming an at least partially closed end of the carton formed from the carton blank and the insert blank.

21. The combination of claim 13, wherein the tab is for extending inwardly from the inner side panel in a first direction when the carton is formed from the carton blank and the insert blank, and the portion of the inner flap is for extending outwardly from the inner side panel in a second direction when the carton is formed from the carton blank and the insert blank, the second direction is opposite the first direction.

22. The combination of claim 13, wherein the tab and the portion of the inner flap are for being coplanar when the carton is formed form the carton blank and the insert blank.

23. A method of forming a carton for holding an article, the method comprises:

obtaining a carton blank and an insert blank, the carton blank comprising a plurality of panels comprising a first panel and a second panel, and the insert blank comprising a central panel, an inner end panel, an inner side panel foldably connected to the central panel, and an inner flap foldably connected to the inner side panel, the inner flap comprises a tab;

forming an interior of the carton at least partially defined by the plurality of panels of the carton blank, the forming the interior of the carton comprising forming an open-ended sleeve; and forming an insert from the insert blank, the forming the insert comprising disposing the inner end panel generally opposite to the central panel, positioning the central panel to be generally parallel to the first panel, positioning the inner side panel to extend generally parallel to the second panel, and positioning the inner flap so that the inner end panel at least partially overlaps the inner flap, the tab extends inwardly from the inner side panel and is at least partially in face-to-face contact with at least the inner end panel, and a portion of the inner flap extends outwardly from the inner side panel in a direction toward the second panel;

wherein the carton blank further comprises an attachment flap foldably connected to the second panel, and the forming the insert further comprises disposing the inner flap at least partially in face-to-face contact with each of the inner end panel and the attachment flap.

24. The method of claim 23, wherein the plurality of panels further comprises a third panel, the forming the insert further comprises disposing the central panel to be at least partially overlapped by and in at least partial face-to-face contact with the first panel and disposing the inner end panel to be at least partially overlapped by and in at least partial face-to-face contact with the third panel.

25. The method of claim 24, wherein the forming the open-ended sleeve comprises positioning the attachment flap at least partially in face-to-face contact with the third panel.

26. The method of claim 23, wherein the forming the insert further comprises positioning the inner end panel to be generally coplanar with the attachment flap.

27. The method of claim 23, wherein the carton blank further comprises at least one end flap foldably connected to a respective panel of the plurality of panels, and the method further comprises forming an at least partially closed end of the carton comprising positioning the at least one end flap over an end of the open-ended sleeve, and inserting the article in the interior of the carton so that the article is at least partially retained by at least the closed end of the carton, the central panel, and the inner side panel.

* * * * *